US008611573B2

(12) United States Patent
Flaig et al.

(10) Patent No.: US 8,611,573 B2
(45) Date of Patent: Dec. 17, 2013

(54) HEARING AID WITH AUDIO SHOE

(75) Inventors: Uwe Flaig, Feucht (DE); Holger Kral, Fürth (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 148 days.

(21) Appl. No.: 13/083,713

(22) Filed: Apr. 11, 2011

(65) Prior Publication Data

US 2011/0249848 A1 Oct. 13, 2011

(30) Foreign Application Priority Data

Apr. 9, 2010 (DE) ..... 10 2010 014 316

(51) Int. Cl.
*H04R 25/00* (2006.01)

(52) U.S. Cl.
USPC ..... 381/322; 381/324; 381/330

(58) Field of Classification Search
USPC ..... 381/150–152, 160–167, 184–433
See application file for complete search history.

(56) References Cited

U.S. PATENT DOCUMENTS

| | | | | |
|---|---|---|---|---|
| 6,430,296 | B1 * | 8/2002 | Olsen | 381/322 |
| 7,519,194 | B2 | 4/2009 | Niederdränk et al. | |
| 7,602,929 | B2 * | 10/2009 | Topholm et al. | 381/322 |
| 8,077,895 | B2 * | 12/2011 | Kral et al. | 381/322 |
| 2007/0047751 | A1 | 3/2007 | Heerlein et al. | |
| 2007/0223767 | A1 | 9/2007 | Jorgensen et al. | |
| 2008/0192970 | A1 | 8/2008 | Nielsen | |
| 2008/0273730 | A1 | 11/2008 | Kral et al. | |
| 2009/0010467 | A1 | 1/2009 | Ritter et al. | |
| 2009/0022348 | A1 | 1/2009 | Kral et al. | |
| 2009/0041277 | A1 | 2/2009 | Kral et al. | |
| 2010/0142736 | A1 | 6/2010 | Aquilina | |

FOREIGN PATENT DOCUMENTS

| | | | |
|---|---|---|---|
| EP | 1838134 | A1 | 9/2007 |
| EP | 2012556 | A1 | 1/2009 |
| WO | 2008110210 | A1 | 9/2008 |

* cited by examiner

*Primary Examiner* — Davetta W Goins
*Assistant Examiner* — Oyesola C Ojo
(74) *Attorney, Agent, or Firm* — Laurence A. Greenberg; Werner H. Stemer; Ralph E. Locher

(57) ABSTRACT

A hearing aid has an audio-shoe interface, and a hearing-aid system includes a hearing aid and an audio shoe. The hearing aid has a housing, in which an undercut and an abutment are provided. The abutment is arranged opposite to the undercut. Undercut and abutment are embodied such that a retaining lug of an audio shoe can be inserted into the undercut by a rotational movement. The abutment is embodied such that a retaining lug inserted into the undercut can only be removed from the undercut again by a rotational movement in the opposite direction. A lock prevents a rotational movement of an inserted audio shoe in the opposite direction. When the electrical contacts between audio shoe and hearing aid are disposed in the undercut, these too are hidden from view and well protected against external influences.

11 Claims, 6 Drawing Sheets

HEARING AID WITH AUDIO SHOE

CROSS-REFERENCE TO RELATED APPLICATION

This application claims the priority, under 35 U.S.C. §119, of German patent application DE 10 2010 014 316.2, filed Apr. 9, 2010; the prior application is herewith incorporated by reference in its entirety.

BACKGROUND OF THE INVENTION

Field of the Invention

The invention relates to a hearing device, such as a hearing aid, with an audio-shoe interface, an associated audio shoe and a hearing-aid system comprising a hearing aid and an audio shoe.

Hearing aids are portable hearing devices used to support the hard of hearing. In order to make concessions for the numerous individual requirements, different types of hearing aids are provided, e.g. behind-the-ear (BTE) hearing aids, hearing aids with an external receiver (receiver in the canal [RIC]) and in-the-ear (ITE) hearing aids, for example concha hearing aids or canal hearing aids (ITE, CIC) as well. The hearing aids listed in an exemplary fashion are worn on the concha or in the auditory canal.

In principle, the main components of hearing aids are an input transducer, signal-processing elements, an amplifier and an output transducer. In general, the input transducer is a sound receiver, e.g. a microphone, and/or an electromagnetic receiver, e.g. an induction coil. The output transducer is usually designed as an electroacoustic transducer, e.g. a miniaturized loudspeaker, or as an electromechanical transducer, e.g. a bone conduction receiver. The amplifier is usually integrated into a signal-processing unit. A battery, integrated into the hearing-aid housing, supplies the hearing aid with current. The main components of a hearing aid are generally arranged on a printed circuit board as circuit mounts, or they are connected thereto.

There are hearing aids whose functionality can be extended by attaching a so-called audio shoe. An attachable, separate functional module that, for example, can comprise telephone functions, entertainment electronics such as a radio and interfaces for entertainment-electronics appliances such as MP3 players is referred to as an audio shoe. A number of hearing aids are capable of coupling in audio signals via a special audio shoe. To this end, an external audio appliance is plugged into the audio shoe. The audio shoe then forms the interface between the hearing aid and the external audio appliance. In the following text, the term audio shoe should denote all feasible separate components that can be connected to a hearing aid by a detachable mechanical and/or electrical connection.

Hearing aids that can be used with an audio shoe have at least one connection contact point for connecting an audio shoe to the printed circuit board of the hearing aid or to the electronic components thereof. An associated audio shoe has corresponding connection contact elements. The connection between audio shoe and hearing aid must firstly be mechanically secure and secondly impart an electronic contact.

An audio shoe usually has a plurality of contacts, e.g. four contacts, that have to be made to contact corresponding contacts on the printed circuit board or on components of the hearing aid. Since printed circuit board and components are usually situated centrally in the hearing-aid housing, whereas the audio shoe is inserted or arranged at the end opposite to the receiver (at the battery compartment end), provision is often made for a special adapter for connecting the contacts of the audio shoe and hearing aid. Metal contacts are molded into the adapter and these are then situated on the external side of the hearing aid. These contacts often corrode, and so there are problems with the contact. It is for this reason that special cover flaps are generally required for the audio shoe. A further disadvantage of the separate adapter is that the production time for a hearing aid is increased by this separate piece.

United States patent application publication US 2007/0047751 A1 describes a hearing aid with an audio shoe that should directly contact the printed circuit board of the hearing aid. For this purpose, the audio shoe has spring contacts that directly engage with corresponding contacts on the printed circuit board when plugged on.

United States patent application publication US 2009/041277 A1 describes a behind-the-ear hearing aid, to which an audio shoe can be detachably coupled on an end face of the housing. A coupling apparatus on the hearing aid comprises a mechanical guide, into which the audio shoe can be plugged by a sliding movement parallel to the end face of the hearing aid. A securing apparatus in the form of a slider that can move across the sliding direction of the audio shoe prevents an unwanted sliding movement of the audio shoe.

United States patent application publication US 2009/022348 A1describes a hearing aid that has a receiving surface for attaching an audio shoe. The audio shoe can be attached in a linear fashion and substantially perpendicular to the receiving surface. A lock with latching lugs can be provided for securing purposes, by means of which the audio shoe is fixed in the hearing aid and which can be released by pressing.

United States patent application publication US 2008/0192970 A1describes a hearing aid with a battery compartment that can pivot and over which an audio shoe can be slid. The audio shoe has a latching lug, by means of which it can be latched over the battery compartment. Moreover, it has a locking mechanism that prevents the battery compartment from being allowed to pivot outward.

SUMMARY OF THE INVENTION

It is accordingly an object of the invention to provide a hearing device with an audio shoe which overcomes the above-mentioned disadvantages of the heretofore-known devices and methods of this general type and which provides for a hearing aid/audio shoe interface that is mechanically stable, affords the electrical contact points the best possible protection from external influences, is as inconspicuous as possible, is easy to handle and can be produced without much complexity.

With the foregoing and other objects in view there is provided, in accordance with the invention, a hearing aid, comprising:

a housing formed with an opening, a recess, an undercut, and an abutment;

each of the recess, the undercut, and the abutment being connected to the opening, the abutment and the undercut being arranged on mutually opposite sides of the opening;

the opening, the recess, the undercut, and the abutment being configured to enable a retaining lug of an audio shoe to be inserted into the undercut through the opening and the recess by a rotational movement around a side of the opening in a vicinity of the undercut;

the abutment being configured to enable the retaining lug, which has been inserted into the undercut, to be removed from the undercut by a rotational movement around the side of the opening in the vicinity of the undercut; and a lock configured for locking a locking component of an audio shoe inserted into the undercut against a rotational movement out of the undercut around the side of the opening in the vicinity of the undercut.

In other words, the objects of the invention are achieved with a hearing aid, an audio shoe, and a hearing-aid system. The hearing aid, the audio shoe, and the combination of the two has the features of the independent patent claims. Advantageous developments emerge from the dependent patent claims.

A basic idea of the invention consists of a hearing aid comprising a housing, wherein an opening, a recess, an undercut and an abutment are provided in the housing. The recess, the undercut and the abutment are connected to the opening. The abutment is arranged on an opposite side of the opening to the undercut. The opening, the recess, the undercut and the abutment are embodied such that a retaining lug of an audio shoe can be inserted into the undercut through the opening and the recess by a rotational movement around the side of the opening lying in the vicinity of the undercut. The abutment is embodied such that a retaining lug inserted into the undercut can only be removed from the undercut by a rotational movement around the side of the opening lying in the vicinity of the undercut. Furthermore, provision is made for a lock, which is embodied such that a locking component of an audio shoe inserted into the undercut can thereby be locked against a rotational movement out of the undercut around the side of the opening lying in the vicinity of the undercut.

The undercut in the housing ensures a very stable mechanical connection between housing and audio shoe. It affords the possibility of dispensing with components protruding from the housing and therefore is optically pleasing and can be handled favorably. There is no need for additional separate components such as axles, axle holders or the like for the mechanical connection, and so it is expedient in terms of the production steps and component logistics during production.

An advantageous development consists of electrical contact surfaces being arranged in the vicinity of the undercut on the inner side of the external housing wall. The contact surfaces can be accessed through the opening and undercut. As a result of being arranged in the undercut, the contact surfaces cannot be seen from the outside, which is optically pleasing. Moreover, this protects said contact surfaces from mechanical wear-and-tear by all types of contact and from environmental influences such as moisture, water, dust and dirt.

A further advantageous development consists of embodying the lock as a notch with a latching lug. This results in a locking mechanism that is particularly easy to handle. There is no need for additional locking components, which is expedient in terms of the production steps and component logistics during production.

As explained above, the combination of undercut and lock is embodied such that an audio shoe can be inserted into the undercut by a combination of sliding and rotational movements and can then be locked with the lock by continuing the movement. This sliding/rotational movement is easy to carry out. In the process, the retaining lug must firstly only be inserted fairly approximately into the housing opening and it is thereupon automatically guided into the precise final position by the rotational movement of the audio shoe. Hence the sliding/rotational movement requires no particular precision in terms of positioning and carrying out the movement, which simplifies the handling.

In a further advantageous development, the recess has an arc-shaped design around the side of the opening lying in the vicinity of the undercut. The arc-shaped design supports the rotational movement of the audio shoe while the retaining lug is being inserted into the undercut. This further simplifies the handling.

A further basic idea of the invention consists of an audio shoe with a retaining lug and a locking component. The retaining lug is embodied such that it can be inserted into an undercut in a housing of a hearing aid, as explained above, by a rotational movement around the side of the opening lying in the vicinity of the undercut. The locking component is embodied such that it can mutually engage in a locking fashion with a lock of a hearing aid, as explained above, for example as a latch or pin or bolt.

The retaining lug can easily be embodied such that a very stable mechanical connection is ensured between housing and audio shoe. It can be molded onto the audio shoe such that no additional separate components such as axles, axle holders or the like are required for the mechanical connection; by way of example, it can be integrally molded on as an injection-molded part. This is expedient in terms of the production steps and component logistics during production.

In an advantageous development, electrical contact surfaces are arranged on the retaining lug. The contact surfaces on the retaining lug are arranged such that they can be brought into contact with electrical contacts, arranged in an undercut, by the insertion of the retaining lug into the undercut of a housing of a hearing aid as explained above. As a result of the arrangement in the undercut—when the retaining lug has been inserted—the contact surfaces are not visible from the outside, which is optically pleasing. Moreover, they are protected from mechanical wear-and-tear by all types of contact and from environmental influences such as moisture, water, dust and dirt.

In a further advantageous development, the locking component is actuated by an elastic force when the audio shoe with the retaining lug has been inserted into an undercut of a housing of a hearing aid as explained above. The elastic force, generated e.g. by a spring or an elastic shape-memory component, brings the locking component into mutual engagement with the lock. This automatically closes the lock, which firstly brings about simple handling and secondly brings about a high degree of safety against inadvertent opening of the lock.

The surface of the retaining lug has a convex arc-shaped design on the side in a further advantageous development. To be precise, the surface designed like this is the one that is oriented toward the recess during the insertion into an undercut in a housing of a hearing aid with the arc-shaped recess as explained above. The convex arc-shaped surface in a way accommodates the concave (as seen from outside of the housing) arc shape of the recess. As a result, the rotational movement during the insertion of the retaining lug is guided in the direction of the undercut. This improves the precision of the positioning of the retaining lug during the insertion. Moreover, it simplifies the insertion movement. Hence, simpler handling is achieved.

A further basic idea consists of a hearing aid system, which comprises a hearing aid, embodied as explained above, and an audio shoe, embodied as explained above.

The mechanical connection on the basis of the undercut in the housing and the retaining lug on the audio shoe ensures high stability. It affords the possibility of dispensing with components protruding from the housing and therefore is optically pleasing and can be handled favorably. There is no need for additional separate components such as axles, axle holders or the like for the mechanical connection, and so it is expedient in terms of the production steps and component logistics during production.

If the electrical contact surfaces are additionally arranged within the undercut, they cannot be seen from the outside, which is optically pleasing. Moreover, this protects said contact surfaces from mechanical wear-and-tear by all types of contact and from environmental influences such as moisture, water, dust and dirt.

As explained above, the combination of undercut and lock is embodied such that an audio shoe can be inserted into the undercut by a combination of sliding and rotational movements and can then be locked with the lock by continuing the movement. This sliding/rotational movement is easy to carry out. In the process, the retaining lug must firstly only be inserted fairly approximately into the housing opening and it is thereupon automatically guided into the precise final position by the rotational movement of the audio shoe. Hence the sliding/rotational movement requires no particular precision in terms of positioning and carrying out the movement, which simplifies the handling.

If the recess and/or the retaining lug are additionally embodied in an arc-shaped concave and convex form, respectively, the rotational movement of the audio shoe is supported when the retaining lug is inserted into the undercut. As a result, the rotational movement during the insertion of the retaining lug is guided in the direction of the undercut. This improves the precision of the positioning of the retaining lug during the insertion. Moreover, it simplifies the insertion movement. Hence, simpler handling is achieved.

If the lock component of the audio shoe is moreover brought into mutual engagement with the lock by an elastic force, generated e.g. by a spring or an elastic shape-memory component, and the lock is closed automatically, this also results in simple handling. Moreover, this ensures a high degree of safety against inadvertent opening of the lock.

The invention, that is, the undercut in the housing ensures a very stable mechanical connection. It affords the possibility of dispensing with components protruding from the housing and therefore is optically pleasing and can be handled favorably. There is no need for additional separate components such as axles, axle holders, pins, or the like for the mechanical connection, and so it is expedient in terms of the production steps and component logistics during production. Moreover, if the electrical contacts between the audio shoe and hearing aid are arranged in the undercut, these too are hidden from view and well protected against external influences.

Other features which are considered as characteristic for the invention are set forth in the appended claims.

Although the invention is illustrated and described herein as embodied in a hearing aid with audio shoe, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 3 shows a sectional view of a hearing aid and an audio shoe, while being plugged on;

FIG. 4 shows a sectional view of a hearing aid with an audio shoe, plugged on;

FIG. 6 shows a perspective view of a hearing aid and an audio shoe, while being plugged on.

DETAILED DESCRIPTION OF THE INVENTION

Figure 1:
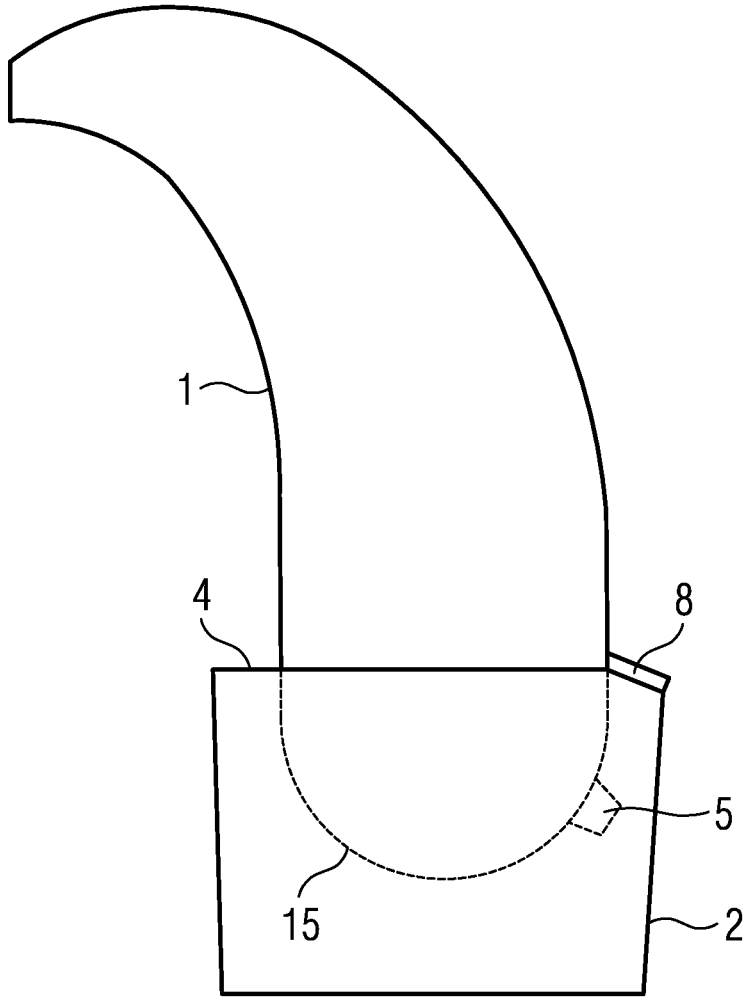
FIG. 1 shows a hearing aid with an audio shoe.

Referring now to the figures of the drawing in detail and first, particularly, to FIG. 1 thereof, there is shown a schematic illustration of a hearing aid 1 with an audio shoe 2. The hearing aid 1 has the housing shape of a BTE (behind-the-ear) hearing aid. The battery is arranged in a battery compartment 15 in the wide, rounded end of the housing. The battery compartment 15 has a lever 5, by way of which it can be opened.

The audio shoe 2 is plugged onto the hearing aid 1. It covers the battery compartment 15 and the lever 5, which is why these have been illustrated using a dashed line. It is locked onto the hearing-aid housing by a retaining lug 8 that extends into the hearing aid 1 and by a lock component 4.

Figure 2:
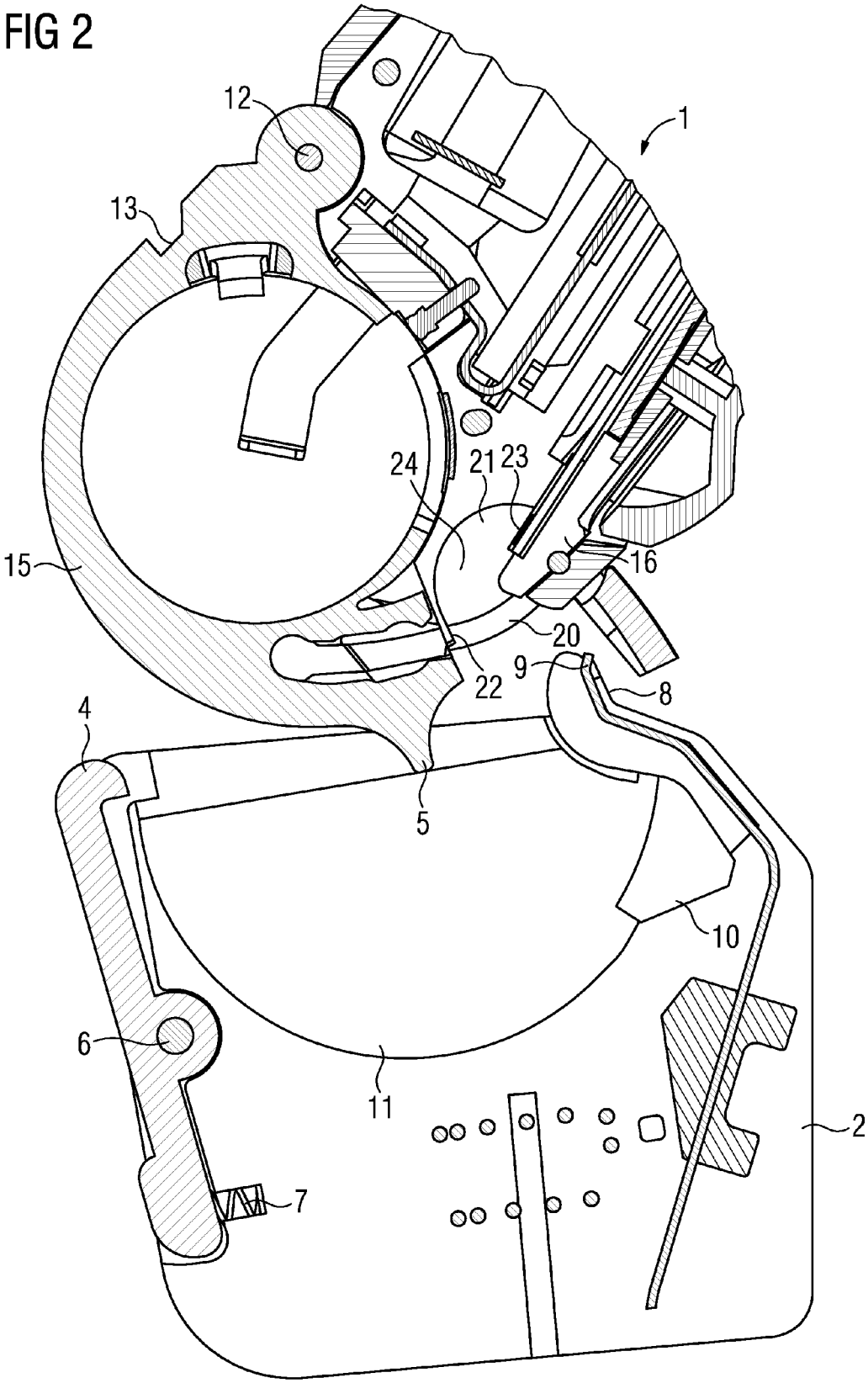
FIG. 2 shows a sectional view of a hearing aid and an audio shoe, separated.

FIG. 2 illustrates a sectional view of part of a hearing aid 1 and a sectional view of an audio shoe 2. The audio shoe 2 is not plugged onto the hearing aid 1.

The hearing aid has a battery compartment 15, which can pivot about a pivot axis 12 and can be opened and closed again by means of a lever 5. In the figure, the battery compartment 15 has been pivoted completely into the hearing-aid housing. Located on the outside of the battery compartment 15, there is a lock in the form of a notch 13, which has a perpendicular edge embodied as a latching lug and a further, flattened edge.

The hearing-aid housing has an opening 20, which leads to a recess 24 within the hearing-aid housing. The recess 24 has a contour with an arc-shaped concave design. It leads to an undercut 21 in the hearing-aid housing, i.e. to a space within the housing that is accessible from outside the housing but, as seen from the outside, is situated behind the housing wall. The region of the opening 20 opposite to the undercut 21 is embodied as an abutment 22, also referred to as a counter-bearing 22, which prevents a straight-line pushing movement into the undercut 21 or a straight-line pulling movement out of the undercut 21.

A circuit mount 16 is arranged in the hearing-aid housing; it has circuit-board conductors and is equipped with signal-processing components and other electronic components of the hearing aid 1. Electrical contact surfaces 23 of the circuit mount 16 are arranged within the undercut 21. They are arranged on the inner side of the hearing-aid housing. As a result, they are not visible from the outside and cannot be accessed directly by a linear movement due to the abutment 22 and their arrangement on the external side in the undercut 21. In this respect, the contact surfaces 23 are not directly exposed to external influences.

The audio shoe 2 has a battery-compartment receptacle 11, which is embodied as a cavity and can accommodate the battery compartment 15. Additionally, provision is made for a lever receptacle 10, which can accommodate the lever 5 of the battery compartment.

A locking component of the audio shoe 2 is formed by a latch 4. The latch 4 is arranged on a rocker, which can be tilted about a tilt axis 6 and is actuated by a spring 7. The spring presses the rocker into the closed, locked position. The latch 4 is embodied such that it can engage into the notch 13 on the battery compartment. It has a latching lug, embodied as a perpendicular edge, which interacts with the latching lug in the notch 13. As soon as the latch 4 engages into the notch 13, the latching lugs on both sides prevent movement of the audio shoe 2 away from the hearing aid 1 (i.e. downward in the figure).

The audio shoe 2 has a retaining lug 8. The retaining lug 8 has an approximately circular-arc-shaped design and in particular has a circular-arc-shaped surface on one side (the longitudinal side facing the hearing aid 1 in the figure). Electrical lines of the audio shoe 2 lead to the retaining lug 8, which lines end in contact surfaces 9 on the retaining lug 8 or are connected thereto.

Figure 3:
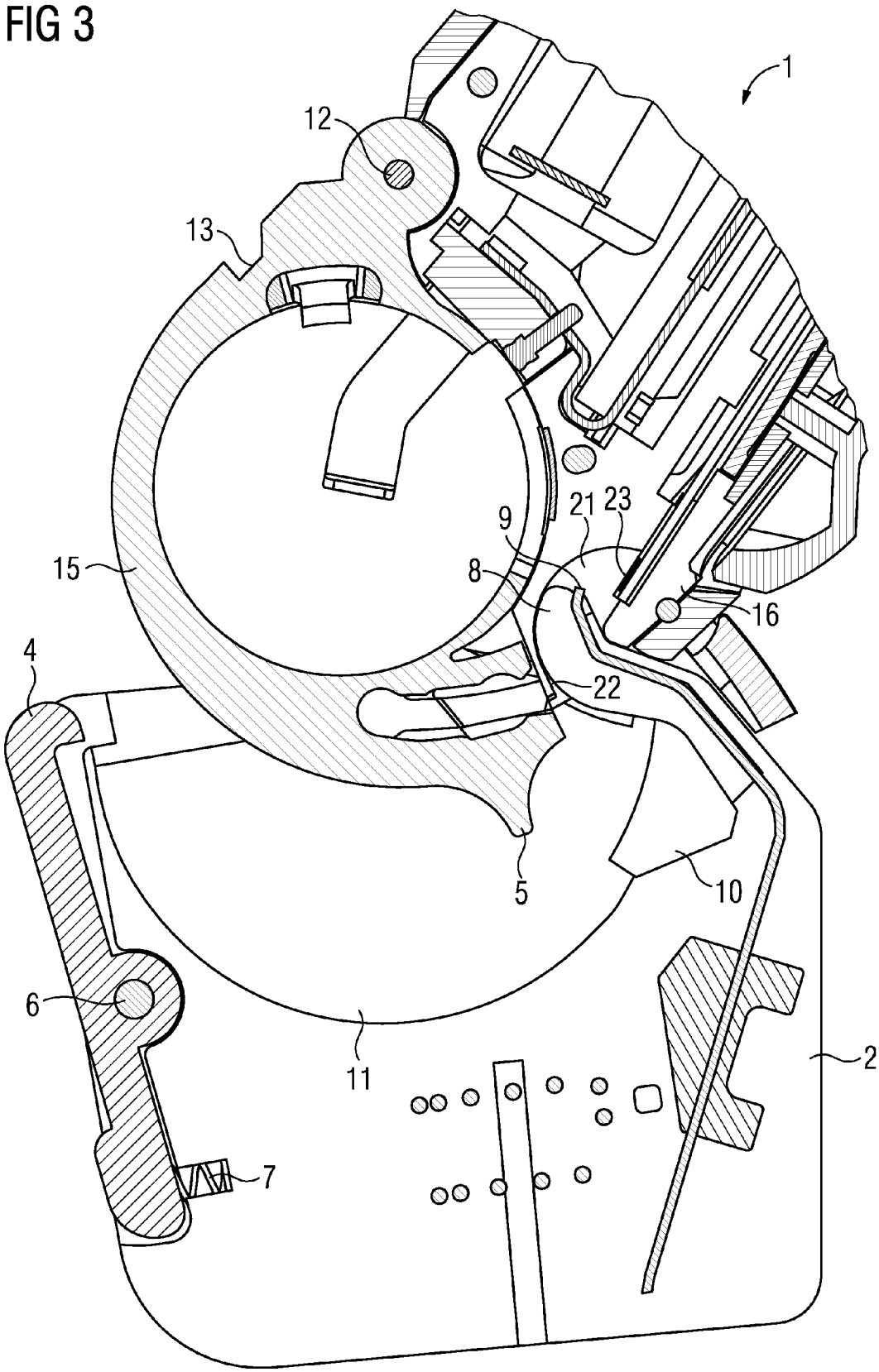

FIG. 3 shows a sectional view of the above-described part of a hearing aid 1 and an audio shoe 2 in a modified position with respect to one another, more precisely while the audio shoe 2 is being plugged onto the hearing aid 1. Moreover, the same components have been used, with the same reference signs, as in the preceding description of the figures, and so reference is made to the preceding description of the figures for a more detailed explanation.

The audio shoe 2 is illustrated while it is being plugged onto the hearing aid 1 and already slightly contacts the latter, namely at the retaining lug 8 of the audio shoe 2 and the recess 24 in the hearing aid 1. This is because for the purposes of plugging on, the retaining lug 8 must firstly be inserted into the recess 24. Since the opening 20 leading to the recess 24 is larger than the tip of the retaining lug 8, the insertion does not require much precision in terms of movement.

The figure makes it possible to identify that although the retaining lug 8 can first of all be inserted into the recess 24 by a straight-line movement as illustrated, further insertion by a straight-line movement is no longer possible because of the overall bent shape of the retaining lug 8 and the geometric design of the opening 20, the recess 24 and, in part, of the abutment 22 as well.

Rather, the retaining lug 8 must be rotated around the side of the opening 20 lying in the vicinity of the undercut 21 for further insertion (i.e. clockwise in the figure). Such a rotational movement is supported and simplified by the arc-shaped design of the recess 24 and the retaining lug 8. This is because the concave arc shape of the recess 24 visibly accommodates the convex arc shape of the side of the retaining lug 8 facing the recess 24.

Figure 4:
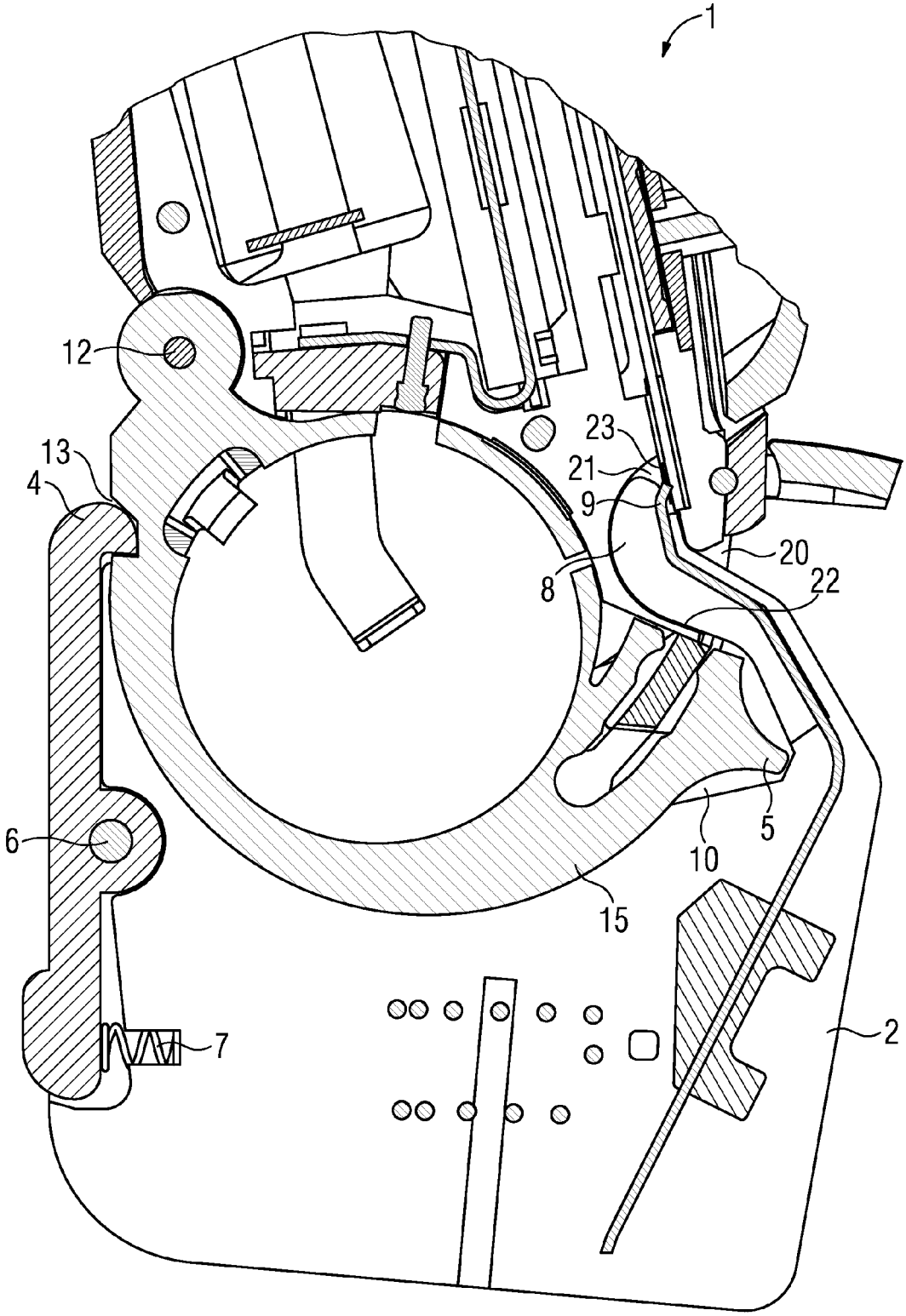

FIG. 4 illustrates a sectional view of the above-described part of a hearing aid 1 with a plugged-on above-described audio shoe 2 using the same reference signs, and so reference is made to the preceding description of the figures for a more detailed explanation.

As a result of the pivoting, or rotational movement around the side of the opening 20 lying in the vicinity of the undercut 21 explained above (clockwise rotation), the audio shoe 2 has been completely plugged onto the hearing aid 1. The retaining lug 8 has thereby been inserted into the undercut 21 through the opening 20 and the recess 24.

At the same time, on the opposite housing side, the latch 4 of the audio shoe 2 has latched into the notch 13 on the battery compartment 15. The latching was brought about by the force from the spring 7, which tilted the rocker in the corresponding direction about the tilt axis 6. The actuation with the force of the spring 7 also causes the latch 4 to remain in the notch 13 and thus to remain in the closed, locked state. The retaining lugs of the latch 4 and the notch 13 prevent the audio shoe 2 from being pulled away from the hearing aid 1 when the lock is closed, or prevent it from being rotated out around the side of the opening 20 lying in the vicinity of the undercut 21 (i.e. being removed in the counterclockwise direction).

On the other hand, on the side of the opening 20 and the retaining lug 8, the abutment 22 prevents the audio shoe 2 from being able to be pulled away from the hearing aid 1. This is because the retaining lug 8 is prevented from such a straight-line movement by the abutment 22, at which the convex arc-shaped side of the retaining lug 8 is present. The abutment 22 is provided for preventing such a straight-line pulling-off of the audio shoe 2. This makes it clear that it is formed by part of the opening 20 and/or recess 24 lying opposite to the undercut 21.

Hence, retaining lug 8 and abutment 22, on the one side, and latch 4 and notch 13, on the other side, prevent the audio shoe 2 from being able to be pulled off the hearing aid 1. It can only be pulled off by releasing the latch 4, i.e. by operating the latch rocker, because only this allows the rotational movement out of the undercut 21 and past the abutment 22.

Figure 5:
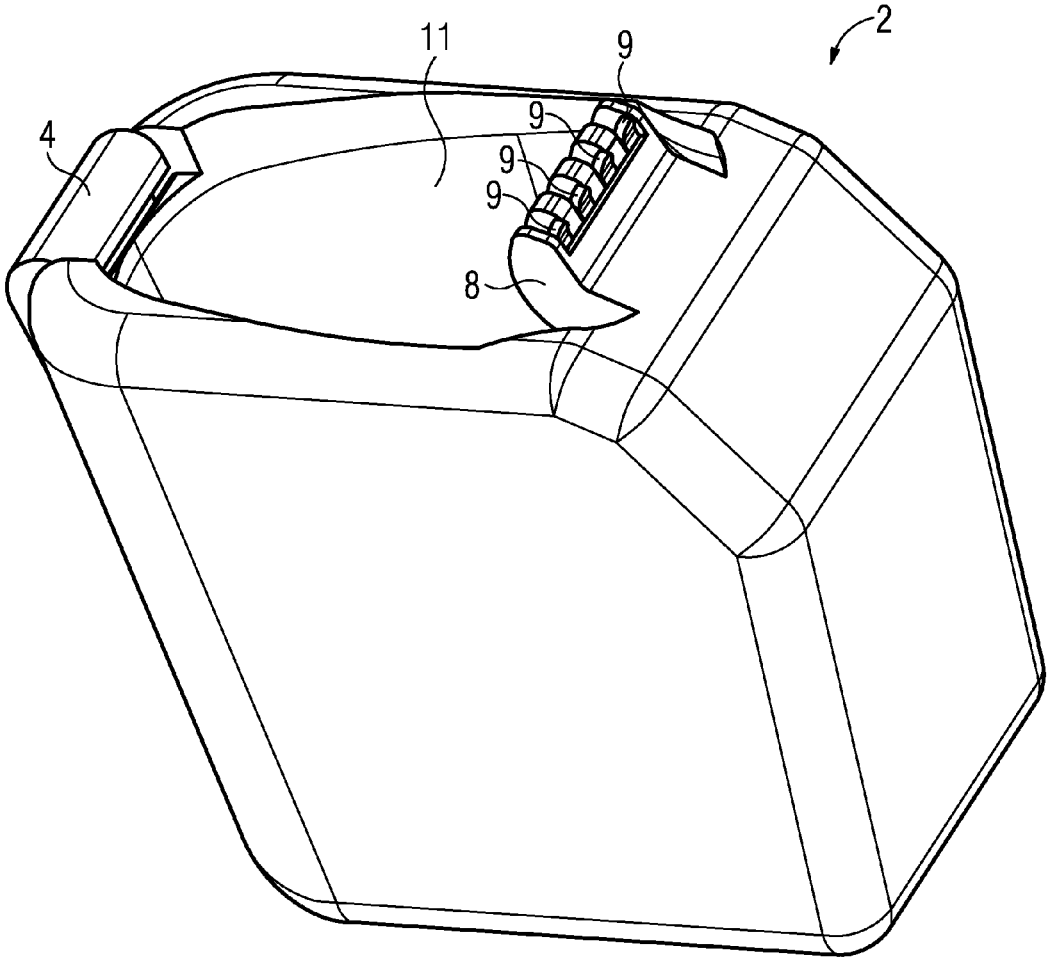
FIG. 5 shows a perspective view of an audio shoe.

FIG. 5 illustrates the audio shoe 2 in a perspective fashion. The plan view shows the side of the audio shoe 2 facing the hearing aid 1 with an opening embodied as a battery-compartment receptacle 11. The latch 4 is on one side of the opening and the retaining lug 8 is on the opposite side. The electrical contact surfaces 9 are arranged on the retaining lug 8.

Figure 6:
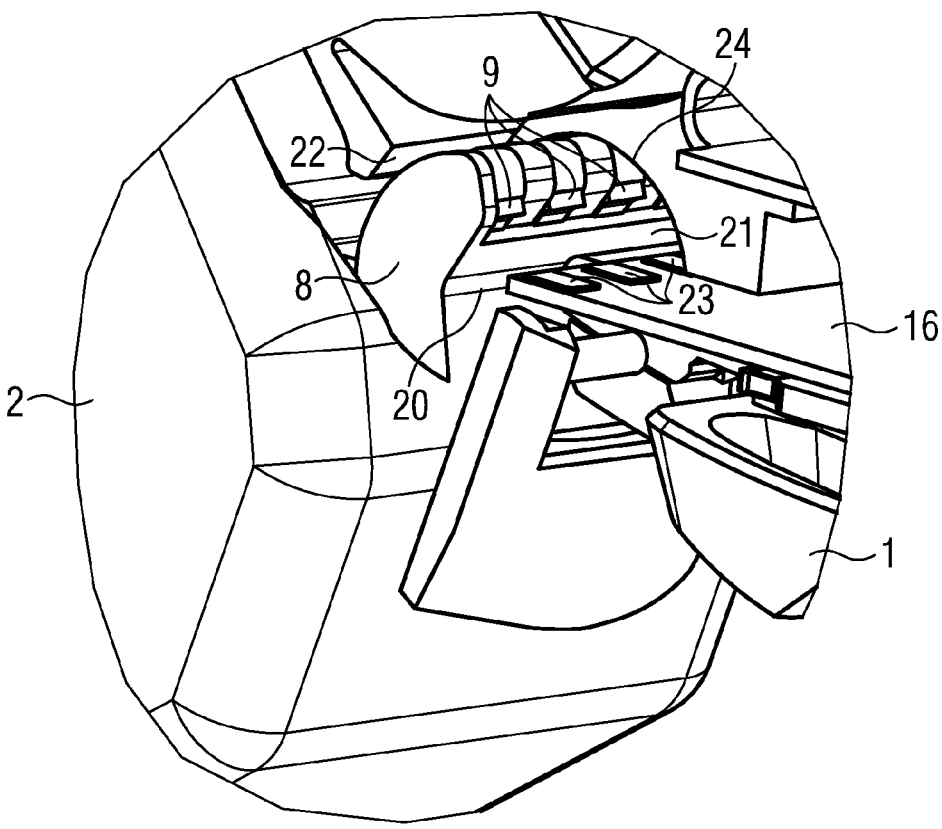

FIG. 6 respectively illustrates part of the hearing aid 1 and the audio shoe 2 in a perspective fashion while the audio shoe 2 is being plugged on. The retaining lug 8 has partly been inserted into the recess 24 through the opening 20 and along the abutment 22. The electrical contact surfaces 9 can be identified on the retaining lug 8.

On the part of the hearing aid 1, the circuit mount 16 with its electrical contact surfaces 23 has been illustrated. This illustration shows parts from the interior of the hearing-aid housing that normally could not be seen through the hearing-aid housing; in this respect, part of the housing has been omitted in the illustration. The contact surfaces 23 are arranged in the undercut 21.

Figure 7:
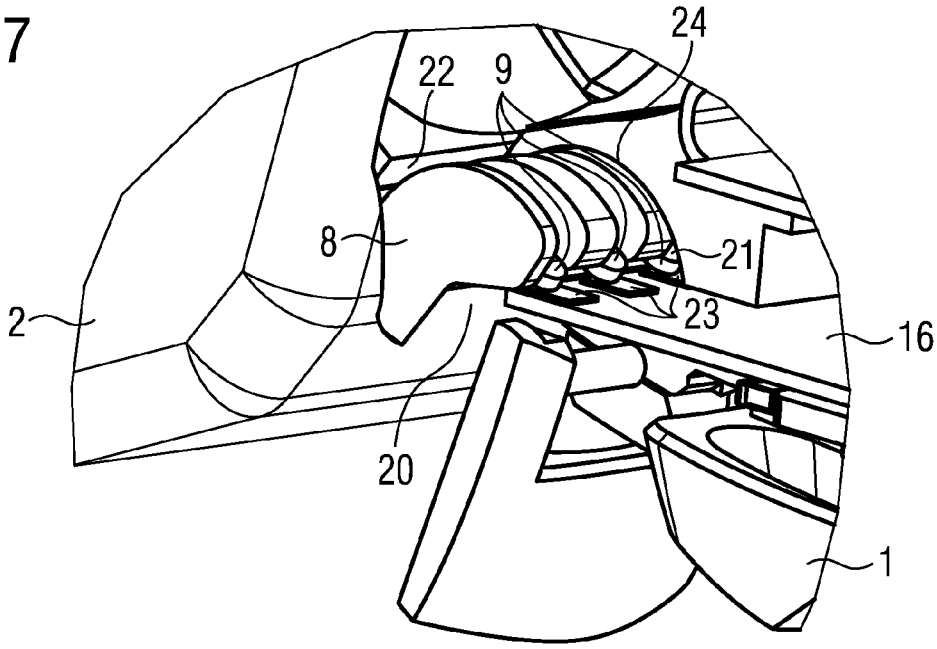
FIG. 7 shows a perspective view of a hearing aid with an audio shoe.

FIG. 7 once again respectively illustrates part of the hearing aid 1 and the audio shoe 2 in a perspective fashion, but this time in an already plugged-together state. The same reference signs have been used as in the preceding figures, and so reference is made to the preceding description of the figures for a more detailed explanation. It can be recognized that the retaining lug 8 has been inserted into the undercut 21. The contact surfaces 9 of the retaining lug 8 are connected to the contact surfaces 23 of the circuit mount 16. As a result, the audio shoe 2 has been connected to the hearing aid 1 both mechanically and electrically.

A basic idea of the invention can be summarized as follows: the invention relates to a hearing aid with an audio-shoe interface, an associated audio shoe and a hearing-aid system comprising a hearing aid and an audio shoe. A basic idea of the invention consists of a hearing aid 1 with a housing, in which an undercut 21 and an abutment 22 are provided. The abutment 22 is arranged opposite to the undercut 21. Undercut 21 and abutment 22 are embodied such that a retaining lug 8 of an audio shoe 2 can be inserted into the undercut 21 by a rotational movement. The abutment 22 is embodied such that a retaining lug 8 inserted into the undercut 21 can only be removed from the undercut 21 again by a rotational movement in the opposite direction. Furthermore, provision is made for a lock that prevents a rotational movement of an inserted audio shoe 2 in the opposite direction. The undercut in the housing ensures a very stable mechanical connection. It affords the possibility of dispensing with components protruding from the housing and therefore is optically pleasing and can be handled favorably. There is no need for additional separate components such as axles, axle holders or the like for the mechanical connection, and so it is expedient in terms of the production steps and component logistics during production. Moreover, if the electrical contacts between audio shoe 2 and hearing aid 1 are arranged in the undercut 21, these too are hidden from view and well protected against external influences.

The invention claimed is:

1. A hearing aid, comprising:

a housing formed with an opening, a recess, an undercut, and an abutment;

each of said recess, said undercut, and said abutment being connected to said opening, said abutment and said undercut being arranged on mutually opposite sides of said opening;

said opening, said recess, said undercut, and said abutment being configured to enable a retaining lug of an audio shoe to be inserted into the undercut through said opening and said recess by a rotational movement around a side of said opening in a vicinity of said undercut;

said abutment being configured to enable the retaining lug, which has been inserted into said undercut, to be removed from said undercut by a rotational movement around the side of the opening in the vicinity of said undercut; and a lock configured for locking a locking component of an audio shoe inserted into said undercut against a rotational movement out of said undercut around the side of the opening in the vicinity of said undercut.

2. The hearing aid according to claim 1, which comprises electrical contact surfaces disposed to be accessed through said opening and said undercut, said contact surfaces being arranged in a vicinity of said undercut on an inner side of an exterior housing wall.

3. The hearing aid according to claim 1, wherein said lock comprises a notch with a latching lug.

4. The hearing aid according to claim 1, wherein said recess has an arc-shaped configuration around a side of said opening in the vicinity of said undercut.

5. An audio shoe, comprising:

a retaining lug configured for insertion into an undercut formed in a housing of a hearing aid according to claim 1, by rotational movement around a side of the opening in a vicinity of the undercut; and a locking component configured for engagement with and interlocking with a lock of the hearing aid according to claim 1.

6. The audio shoe according to claim 5, wherein said retaining lug is formed with electrical contact surfaces disposed and configured to be brought into contact with electrical contacts, arranged in an undercut, of the hearing aid according to claim 2, when said retaining lug is inserted into the undercut of the housing of the hearing aid.

7. The audio shoe according to claim 5, wherein said locking component is brought into engagement with the lock by being actuated by an elastic force when the audio shoe with said retaining lug has been inserted into an undercut of the housing of the hearing aid according to claim 1.

8. The audio shoe according to claim 5, wherein the recess in the housing of the hearing aid has an arc-shaped configuration around a side of the opening in the vicinity of the undercut, and said retaining lug is formed with a convex arc-shaped surface on the side thereof oriented toward said recess during an insertion thereof into the undercut in the housing of the hearing aid.

9. A hearing aid system, comprising:

a hearing aid according to claim 1; and an audio shoe including:

a retaining lug configured for insertion into said undercut formed in said housing of the hearing aid, by rotational movement around a side of said opening in a vicinity of said undercut; and a locking component configured for engagement with and interlocking with the lock of the hearing aid.

10. A hearing aid, comprising:

a housing formed with an opening, a recess, an undercut, and an abutment, said housing having an exterior wall with an inner side;

each of said recess, said undercut, and said abutment being connected to said opening, said abutment and said undercut being arranged on mutually opposite sides of said opening;

said opening, said recess, said undercut, and said abutment being configured to enable a retaining lug of an audio shoe to be inserted into the undercut through said opening and said recess by a rotational movement around a side of said opening in a vicinity of said undercut;

said abutment being configured to enable the retaining lug, which has been inserted into said undercut, to be removed from said undercut by a rotational movement around the side of the opening in the vicinity of said undercut;

a lock configured for locking a locking component of an audio shoe inserted into said undercut against a rotational movement out of said undercut around the side of the opening in the vicinity of said undercut; and electrical contact surfaces disposed on said inner side of said exterior housing wall in a vicinity of said undercut, wherein said electrical contact surfaces are accessible through said opening and said undercut.

11. An audio shoe, comprising:

a retaining lug configured for insertion into an undercut formed in a housing of a hearing aid according to claim 10, by rotational movement around a side of the opening in a vicinity of the undercut; and a locking component configured for engagement with and interlocking with a lock of the hearing aid according to claim 10;

said retaining lug carrying electrical contact surfaces disposed and configured to be brought into contact with said electrical contacts of the hearing aid according to claim 10 when said retaining lug is inserted into the undercut of the housing of the hearing aid.

* * * * *